US011208734B2

(12) United States Patent
King et al.

(10) Patent No.: US 11,208,734 B2
(45) Date of Patent: Dec. 28, 2021

(54) ELECTROSPINNING DEVICE AND CONFIGURATION METHOD

(71) Applicant: UNIVERSITY OF SURREY, Guildford (GB)

(72) Inventors: Simon King, Godalming (GB); Vlad Stolojan, Guildford (GB); Sembukuttiarachilage Silva, Guildford (GB)

(73) Assignee: University of Surrey, Surrey (GB)

( * ) Notice: Subject to any disclaimer, the term of this patent is extended or adjusted under 35 U.S.C. 154(b) by 514 days.

(21) Appl. No.: 15/748,159

(22) PCT Filed: Jul. 27, 2016

(86) PCT No.: PCT/GB2016/052293
§ 371 (c)(1),
(2) Date: Jan. 26, 2018

(87) PCT Pub. No.: WO2017/017442
PCT Pub. Date: Feb. 2, 2017

(65) Prior Publication Data

US 2018/0223451 A1 Aug. 9, 2018

(30) Foreign Application Priority Data

Jul. 29, 2015 (GB) ..... 1513328

(51) Int. Cl.
*D01D 5/00* (2006.01)
*D01D 5/28* (2006.01)

(52) U.S. Cl.
CPC ..... *D01D 5/0069* (2013.01); *D01D 5/003* (2013.01); *D01D 5/0061* (2013.01); *D01D 5/0084* (2013.01); *D01D 5/0092* (2013.01); *D01D 5/28* (2013.01)

(58) Field of Classification Search
CPC .... D01D 5/0069; D01D 5/003; D01D 5/0061; D01D 5/0084; D01D 5/0092; D01D 5/28; B01D 2323/39
See application file for complete search history.

(56) References Cited

U.S. PATENT DOCUMENTS 4,235,829 A * 11/1980 Partus ..... B01D 1/0082 137/209
7,351,052 B2 * 4/2008 Chun ..... D01D 5/0069 425/174.8 E
2006/0228435 A1 10/2006 Andrady et al.
(Continued)

FOREIGN PATENT DOCUMENTS

CN 203 583 026 U 5/2014

*Primary Examiner* — Joseph S Del Sole
*Assistant Examiner* — John Robitaille
(74) *Attorney, Agent, or Firm* — Knobe, Martens Olson & Bear, LLP

(57) ABSTRACT

An electrospinning device is for manufacturing material that includes aligned nano-fibers. The device includes a rotor and more than one electrically conducting protrusions disposed on the surface of the rotor and spaced apart from one another. The protrusions are configured such that an electrostatic field created when a potential difference is applied between the rotor and a target is concentrated at the tips of the protrusions and decreases between neighboring protrusions.

18 Claims, 15 Drawing Sheets

(56) References Cited

U.S. PATENT DOCUMENTS

| | | | | |
|---|---|---|---|---|
| 2007/0018361 | A1* | 1/2007 | Xu | D01F 9/08<br>264/465 |
| 2008/0307766 | A1 | 12/2008 | Petras et al. | |
| 2010/0272847 | A1 | 10/2010 | Mares et al. | |
| 2014/0353860 | A1 | 12/2014 | Velásquez-García et al. | |

* cited by examiner

ELECTROSPINNING DEVICE AND CONFIGURATION METHOD

FIELD

The present invention relates to an electrospinning device and configuration method. More specifically, the present invention relates to an electrospinning device for manufacturing material comprising aligned or non-aligned nano-fibres in a controlled manner.

BACKGROUND

Nanotubes, for example carbon nanotubes, silicon nanotubes, and boron nitride nanotubes, are nanometer-scale tube-like structures with a high length to diameter ratio. Nanotubes can be grown using a number of well-known means. Electrospinning devices are used to form nano-fibres from a polymer solution having nanotubes suspended in it. The nano-fibres can be processed to form structures such as sheets, ropes, 3D foams, bio-mimetic structures, and wires.

A known electrospinning device comprises an electrode in the shape of a drum, having a potential difference applied between it and a target collector. The drum may be cylindrical in shape, or may be a wire frame, or may have a frame that is virtual, but will present a 'surface' for spinnerets to operate from. As the drum rotates, droplets of the polymer solution form on its spinnerets, which are positioned on the surface of the drum in such a way as to generate an electromagnetic field having equal intensity along the whole length of the drum. Due to the effects of the electrostatic field resulting from the applied potential difference, the droplets of polymer form a cone. At a critical point, known as a Taylor Cone, a charged liquid jet erupts from the surface of the droplets. As the jet of material travels from the electrode to the target collector, it exhibits a whipping motion, during which it dries and stretches. As it does so, the polymer solidifies to form a polymer fibre, whilst at the same time aligning the 1D-structures along the fibre axis.

In order to generate the necessary Taylor Cones for nano-fibre formation, a significant electrostatic field strength is typically required (which varies according to the liquid used). Generating this field strength in traditional high-throughput electrospinning devices can require typical voltages in the region of 60-120 kV. At these high input voltages, undesirable arcing and sparking can occur. Additionally, these electrospinning devices are expensive and potentially hazardous to operate, with the high voltage requiring many safety features that increase the complexity and its applicability.

The present invention provides an electrospinning device that can generate the required electrostatic field strengths evenly across the field-enhancing protrusions, whilst operating at a more manageable and cost effective input power. Additionally, the present invention provides an electrospinning device that can be used to control the alignment, deposition and diameter of produced nano-fibres.

SUMMARY

According to a first aspect of the present invention, there is provided an electrospinning device for manufacturing material comprising aligned nano-fibres, the electrospinning device comprising: a rotatable member; and a plurality of electrically conducting protrusions disposed on the surface of the rotatable member and spaced apart from one another, wherein the protrusions are configured such that an electrostatic field created when a potential difference is applied between the rotatable member and a target is concentrated at the tips of the protrusions and decreases between neighbouring ones of the protrusions.

In embodiments of the present invention, the protrusions can be configured to concentrate the electromagnetic field at the tips by selecting suitable aspect ratios and spacing between the protrusions. For example, in some embodiments of the invention, the protrusions may be spaced apart such that any two neighbouring protrusions are spaced apart by a distance equal to at least twice the height of either one of said two neighbouring protrusions, and/or the protrusions may each have an aspect ratio of at least 1:10.

The rotatable member may be a drum, and/or may have a skeletal frame structure.

The electrospinning device may further comprise a brush member, extending the full width of the rotatable member, arranged to contact the protrusions when the rotatable member is rotated.

The electrospinning device may further comprise at least one field modifier electrically connected to the rotatable member for controlling the strength and uniformity of the electrostatic field across the length of the rotatable member.

A field modifier may be arranged at each end of the rotatable member. The field modifiers may be arranged co-axially with the axis of the rotatable member.

Alternatively, at least one field modifier may be arranged on the surface of the rotatable member. The at least one field modifier may extend at right angles to the axis of the rotatable member to a height between the tips of the protrusions and the target.

The protrusions may comprise spinnerets, wherein the surface of each spinneret converges to form a point at the tip of the spinneret. The protrusions may be conical.

The protrusions may be arranged in evenly spaced uniform rows along the rotational axis of the rotatable member.

The electrospinning device may be configured to enable the rotatable member to translate up and down.

According to a second aspect of the present invention, there is provided a system comprising an electrospinning device as previously described; a target for receiving nano-fibres from the protrusions; a means for generating a potential difference between the rotatable member and the target; and a first reservoir arranged to contain a liquid comprising nanotubes, wherein the protrusions receive the liquid from the first reservoir when the rotatable member is rotated.

The system may further comprise a second reservoir in fluid communication with the first reservoir for supplying the reservoir with the first liquid.

The walls of the first reservoir may extend beyond the surface of the rotatable member that faces the first reservoir when the rotatable member is disposed above the first reservoir.

The electrospinning device may be configured to enable a height of the rotatable member relative to the reservoir to be adjusted.

According to a third aspect of the present invention, there is provided a method of configuring an electrospinning device for manufacturing material comprising aligned nano-fibres, the electrospinning device comprising a plurality of electrically conducting protrusions disposed on the surface of a rotatable member and spaced apart from one another, the method comprising: determining a configuration of the protrusions such that an electrostatic field created when a potential difference is applied between the rotatable member and a target is concentrated at the tips of the protrusions and decreases between neighbouring ones of the protrusions; and arranging the plurality of protrusions on the surface of the rotatable member according to the determined configuration.

The protrusions may be configured by arranging the spacing between two neighbouring protrusions to be equal to at least twice the height of either one of said two neighbouring protrusions.

The protrusions may each have an aspect ratio of at least 1:10.

BRIEF DESCRIPTION OF THE FIGURES

The present invention will now be described, by way of example only, with reference to the accompanying drawings, in which:

FIG. 1*o* shows a system according to an embodiment of the present invention.

In the drawings, like reference numerals refer to like features throughout.

DETAILED DESCRIPTION

Figure 1:
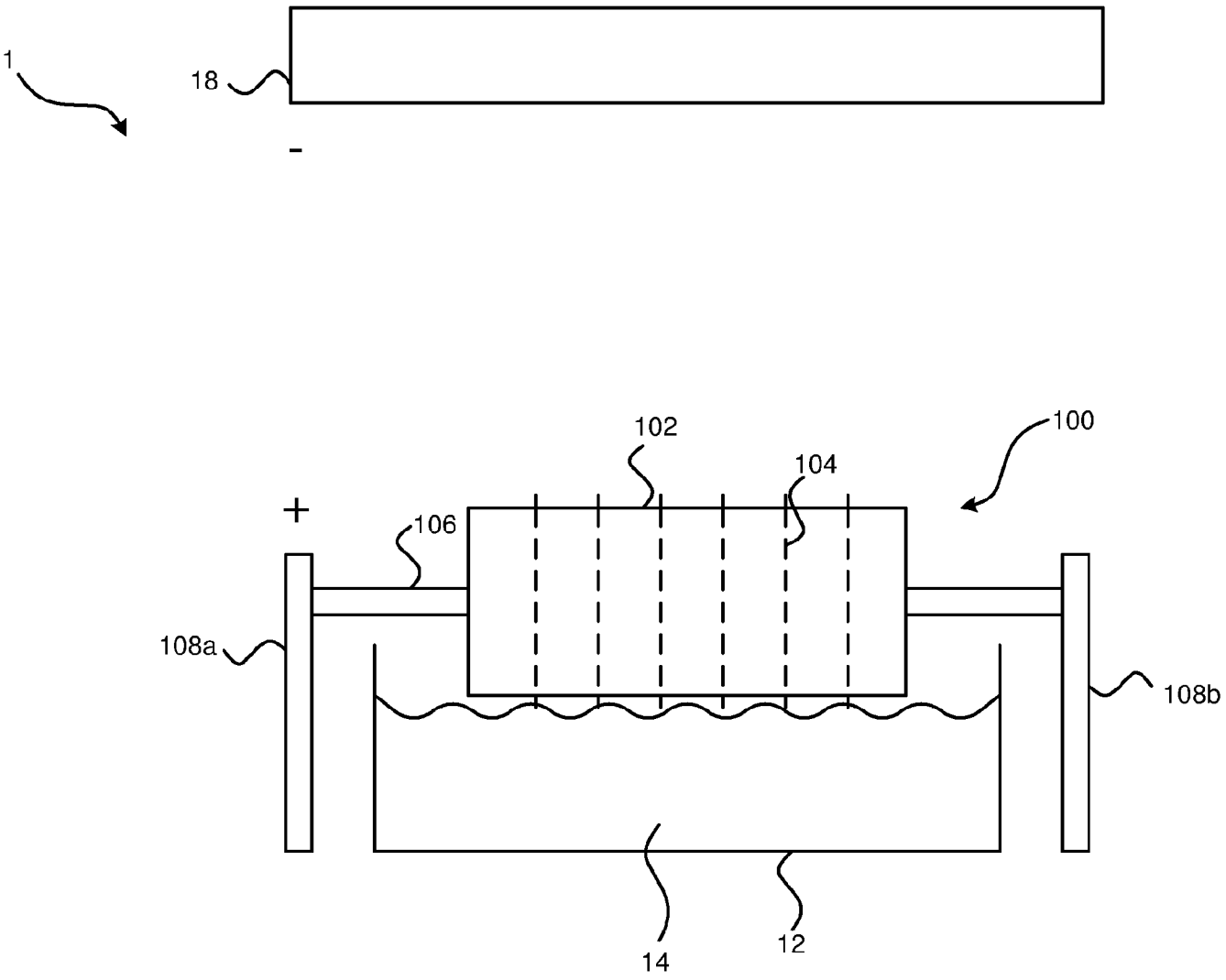
FIG. 1 shows a system according to an embodiment of the present invention.

With reference to FIG. 1, a system 1 is shown that includes an electrospinning device 100 for aligning nanofibres 22 into wires or sheets.

As explained in more detail with reference to FIG. 4, nano-fibres 22 are polymer fibres that comprise a plurality of aligned nanotubes 24. The nanotubes 24 are themselves aligned within each nanotube fibre 22. The nanotubes 24 align according to the plane in which the nano-fibre 22 is stretched/drawn. Aligned nanotubes 24 create a stronger nano-fibre 22 with better electrical properties. The properties of the produced sheets/foams/wires can be tailored by using different types of nanotubes 24, with different doping, or different functionality, which will be encompassed within the nano-fibre 22 during the use of the electrospinning device. The nanotubes 24 may be coated in a surfactant to prevent the nanotubes 24 from agglomerating.

The system 1 further includes a reservoir 12 that is filled with a liquid 14 having nanotubes 24 suspended in it. The liquid 14 is viscous and can be based on any solvent system, including water. Specifically, the liquid 14 may be an aqueous polyethylene oxide solution. Other example solvent systems can include, acetone based cellulose acetate solutions, and dimethylformamide based polyacrylonitrile solutions.

The electrospinning device 100 comprises a rotatable drum 102. The rotatable drum 102 is supported by legs 108*a*, 108*b*. A spindle 106, about which the rotatable drum 102 rotates, is inserted into both the rotatable drum 102 and each of the legs 108*a*, 108*b*. As shown in more detail with reference to FIG. 9, the legs 108*a*, 108*b* comprise a retaining mechanism no for receiving the spindle 106. The spindle 106 in this embodiment is electrically connected to the rotatable drum 102.

The rotatable drum 102 is configured to have an adjustable height. The height of the rotatable drum is defined as being relative to the surface of the liquid 14, and so effectively the rotatable drum 102 can be raised or lowered. In other words, the spindle 106 is arranged to slide within the retaining mechanism 110 of the legs 108*a*, 108*b* in a direction parallel to the longest side of the legs 108*a*, 108*b*. Advantageously, this allows the rotatable drum 102 to remain in contact with the surface of the liquid 14 as the amount of liquid 14 in the reservoir 12 reduces. The retaining mechanism 110 may comprise a biasing means, such as a spring or damper. Alternatively, the retaining mechanism 110 may be electronically controlled.

Various forms are possible for the rotatable member 102. In the present embodiment the rotatable member is a cylindrical drum, but in other embodiments the rotatable member could have a different cross-section, for example a polygonal cross-section. The surface of the rotatable member may be solid or may include one or more openings. Also, in some embodiments the rotatable member may have a skeletal frame structure comprising struts connected at vertices to form a rotatable body on which the protrusions for electrospinning can be mounted.

The rotatable drum 102 is configured to rotate with a sufficient angular velocity to allow the formation of Taylor Cones while preventing the solution from drying on the drum's surface. At high velocities, the Taylor Cones are prone to collapsing or not forming at all. At low velocities, the solution coating of the drum's surface is prone to solidifying or depletion. A typical rotational velocity of the rotatable drum 102 is in the region of 5-10 revolutions per minute. Upon scaling the drum, the correct balance between viscous forces and surface tension, centrifugal forces and the electrostatic field must be established for continuous electrospinning.

A plurality of conical protrusions 104 are disposed on the surface of the rotatable drum 102. The protrusions 104 are arranged to receive liquid 14 from the reservoir 12. The shape and position of the protrusions 104 will be described in more detail later with reference to FIGS. 3*a* to *d*. The protrusions 104 are configured to enhance the field strength of an electrostatic field applied across them when the system 1 is in operation. Specifically, the protrusions are configured such that an electrostatic field created when a potential difference is applied between the rotatable member and a target is concentrated at the tips of the protrusions and decreases between neighbouring ones of the protrusions.

To achieve this field enhancement, in embodiments of the present invention the protrusions can be configured by selecting suitable aspect ratios and/or spacing between the protrusions. The protrusions 104 can be configured to have high aspect ratios. In the present embodiment, the protrusions 104 have aspect ratios (width-to-height) of at least 1:10. Additionally, in the present embodiment the protrusions 104 are spaced apart by a distance of at least twice the height of the protrusions 104, where the protrusions 104 are all of the same height as each other. Investigations by the inventors have shown that an aspect ratio of at least 1:10, and a spacing of at least 2 times the protrusion height, is sufficient to concentrate the electromagnetic field at the tips in order to cause the formation of Taylor Cones at the tips. In some embodiments, the spacing between protrusions may be at least 2.5 times the height of one of the protrusions 104. Advantageously, the field enhancement caused by the configuration of the protrusions 104 can enable an electrostatic field of a given strength to be generated at the tips of the protrusions 104 using a lower input voltage than would be required in a conventional electrospinning device. In general, any shape of protrusions may be used. For example, the protrusions 104 may have a circular or polygonal base. The vertices of the conical protrusions 104 may converge to meet at an apex. Alternatively, the vertices may be parallel.

Figure 11:
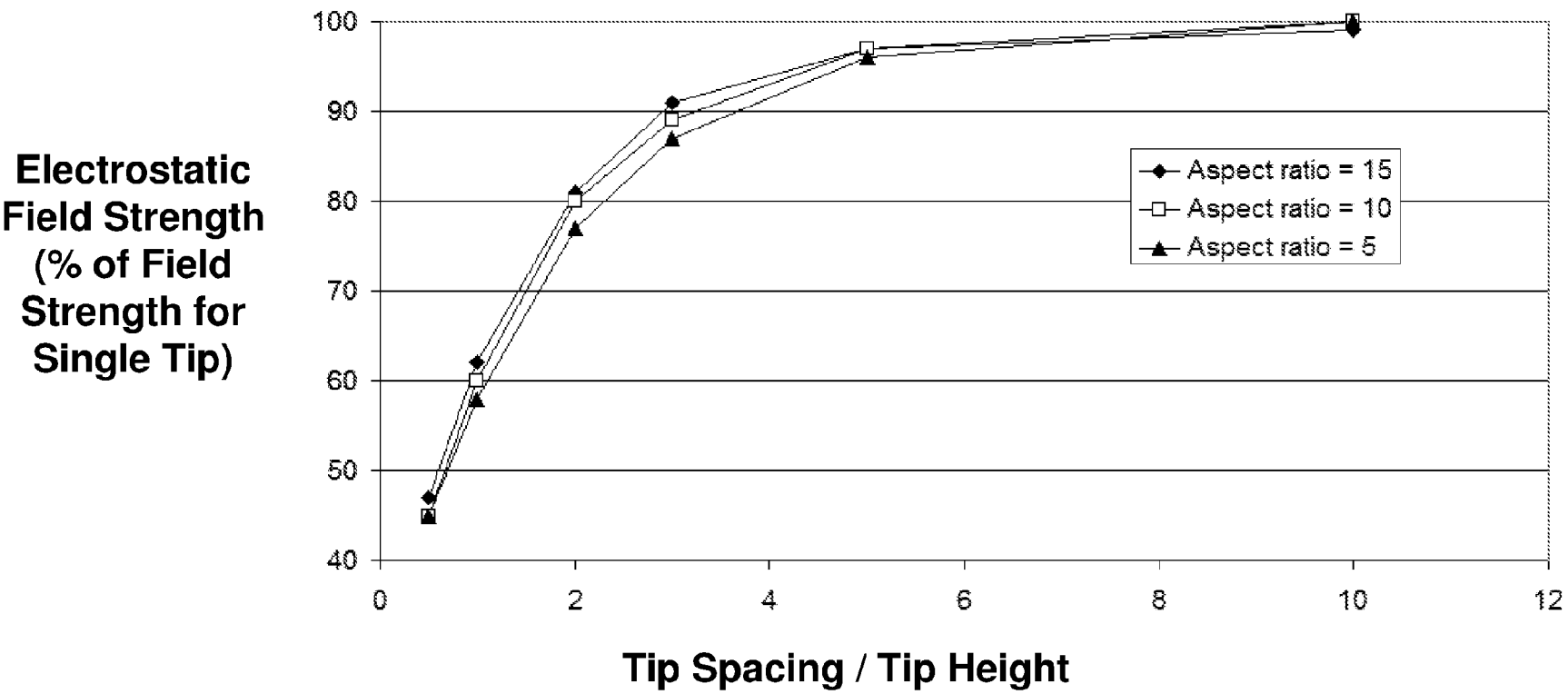
FIG. 11 is a graph plotting the variation in electrostatic field strength at the tip of a protrusion as a function of the tip spacing, for different aspect ratios, according to an embodiment of the present invention.

A graph plotting the variation in electrostatic field strength at the tip of a protrusion as a function of the tip spacing, for different aspect ratios, is shown in FIG. 11. The electrostatic field strength in FIG. 11 is expressed as a percentage of the electrostatic field strength at a single isolated tip with a high aspect ratio (1:15), similar to a syringe needle. As shown in FIG. 1*i*, the electrostatic field strength at the tip decreases as the spacing between neighbouring protrusions decreases, and also decreases as the aspect ratio decreases. A tip spacing of at least 2× height results in an electrostatic field with a strength approximately equal to at least 80% that of the ideal case (single high-aspect ratio tip), which is sufficient to cause formation of Taylor Cones. The electrostatic field strength is more strongly dependent on the tip spacing than on the aspect ratio. The data plotted in FIG. 11 is given below in Table 1, including data for intermediate aspect ratios between those plotted in FIG. 11.

TABLE 1

| Aspect | Tip spacing (multiple tips) | | | | | | Single |
|---|---|---|---|---|---|---|---|
| ratio | 0.5 | 1 | 2 | 3 | 5 | 10 | tip |
| 15 | 47% | 62% | 81% | 91% | 97% | 99% | 100% |
| 14 | 46% | 62% | 81% | 90% | 97% | 100% | 98% |
| 13 | 46% | 61% | 81% | 90% | 97% | 100% | 95% |
| 12 | 46% | 61% | 80% | 90% | 97% | 100% | 92% |
| 11 | 46% | 61% | 80% | 90% | 97% | 100% | 89% |
| 10 | 45% | 60% | 80% | 89% | 97% | 100% | 86% |
| 9 | 45% | 60% | 79% | 89% | 96% | 100% | 82% |
| 8 | 45% | 59% | 79% | 89% | 96% | 100% | 79% |
| 7 | 45% | 59% | 78% | 88% | 96% | 100% | 75% |
| 6 | 45% | 59% | 78% | 88% | 96% | 100% | 70% |
| 5 | 45% | 58% | 77% | 87% | 96% | 100% | 65% |

Although in the present embodiment the protrusions are configured to have a tip spacing of 2× height and an aspect ratio of 1:10, in other embodiments a different configuration may be used, including a lower aspect ratio and/or more closely-spaced protrusions. Electrospinning is still possible when the field strength at the tip drops below 80% that of the single-tip case, however, this requires either a higher input voltage to be used or the tips to be brought closer to the target on which fibres are deposited. Reducing the distance between the tips and the target has the drawback that the travel time of the fibre from leaving the protrusion to hitting the target is reduced. This leads to a lower quality product (less uniformity of fibres and poorer alignment), since the fibres have less time to stretch, straighten and dry in flight before hitting the target. By configuring the protrusions so as to enhance the electrostatic field at the tips as described above, embodiments of the present invention can allow a larger separation to be maintained between the rotating drum and the target without having to increase the input voltage.

As a result of the configuration of the protrusions, particularly the aspect ratio and spacing of the protrusions 104, the electrostatic field strength is concentrated at the tips of the protrusions 104 and is reduced in the space between the protrusions 104. When designing the electrospinning device 100, the aspect ratio and/or the spacing of the protrusions 104 can be determined such that the electrostatic field created when a potential difference is applied between the rotatable drum 102 and the target 18 is concentrated at the tips of the protrusions 104 and decreases between neighbouring ones of the protrusions. The protrusions 104 having the determined aspect ratio and spacing can then be applied to the surface of the rotatable drum 102. Although not to scale, possible arrangements of protrusions 104 applied to the surface of a rotatable drum 102 are shown in FIGS. 3*a* to 3*d*.

The system 1 comprises a target 18 that is arranged to face the electrospinning device 100. The target 18 is configured to have an opposite or ground potential in relation to the rotatable drum 102, when the potential difference is applied. For example, the target 18 may be connected to ground 20, such that it has zero potential. The target 18 receives the aligned nano-fibres from the electrospinning device 100. In some embodiments, the target 18 is a rotatable drum that may rotate at the same rate as the rotatable drum 102 of the electrospinning device 100. The receiving plane could also be a movable conveyor or frame that has the ability to hold a substrate in position for the solution polymer to be deposited. Alternatively, the target 18 may rotate at a rate higher than that of the rotatable drum 102 of the electrospinning device 100 to further stretch the nano-fibres 22. The use of a drum as the target 18 is advantageous as it allows a plurality of aligned nano-fibres to be easily stored for later processing.

The system 1 further includes a power supply (not shown). The power supply is electrically connected to the electrospinning device 100. The power supply is configured to supply a voltage to generate an electrostatic field between the rotatable drum 102 and the target 18. The power supply, or a separate power supply, is further used to drive the rotatable drum 102.

The power supply may be any known power supply capable of sustaining an input voltage of up to −60 kV. The input voltage is dependent on the liquid polymer 14 used. Advantageously, this input voltage can be kept relatively low as a result of the field enhancement techniques. In addition to generating an electrostatic field, the power supply, or a separate power supply (not shown), drives the rotatable drum 102 to rotate.

The target 18 may be coated with an anionic coating. In this case, the target 18 is arranged to be electrically negatively biased. Alternatively, the target 18 may be coated with a cationic coating. In this case, the electrical biasing of the target 18 is not important. Here, the choice of direction of the electrostatic field depends on the surfactant coating the nanotubes 24 and chemistry of the liquid polymer 14.

Figure 2A:
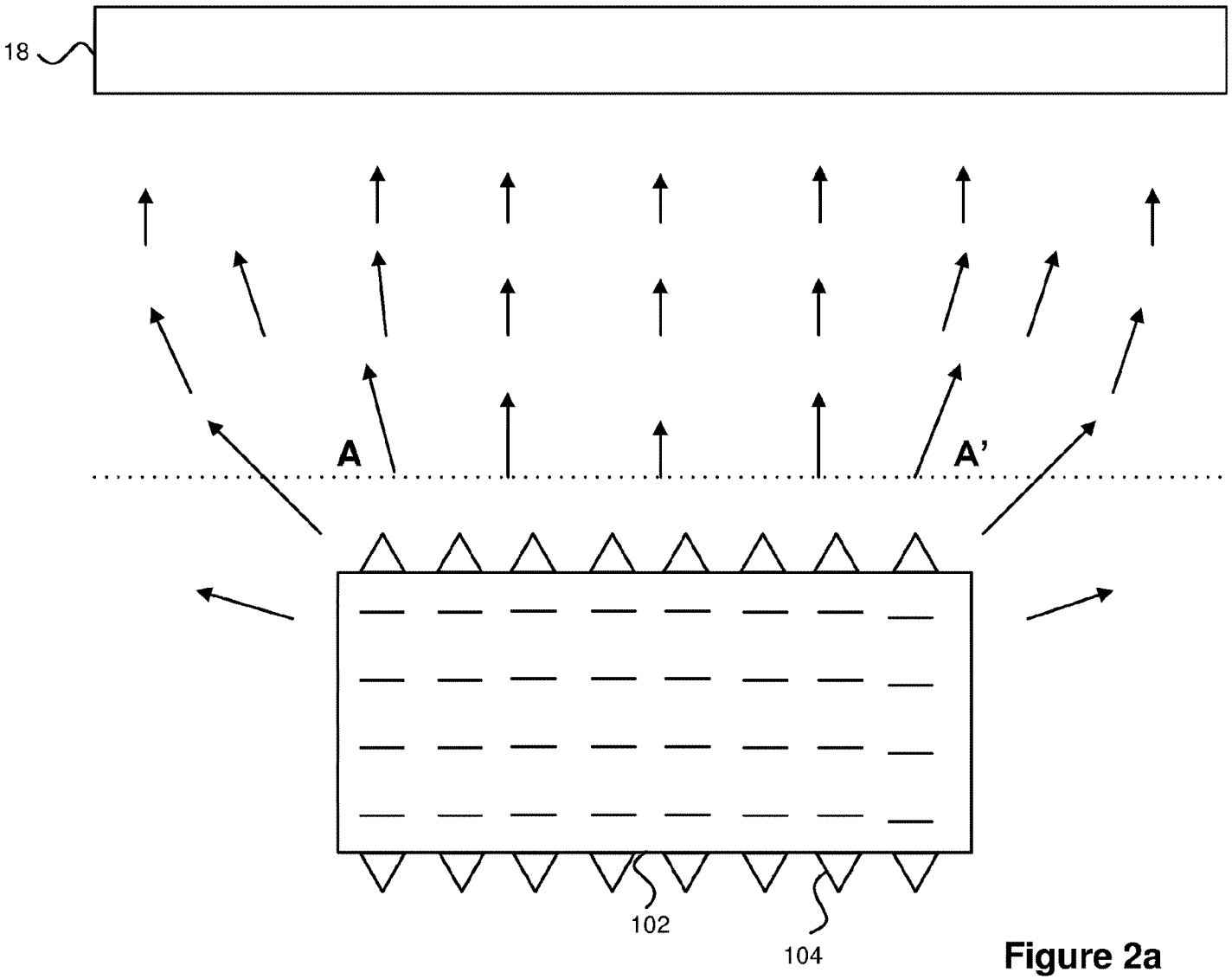
FIG. 2*a* shows a schematic of an electrostatic field diagram associated with the electrospinning device of FIG. 1.
Figure 2B:
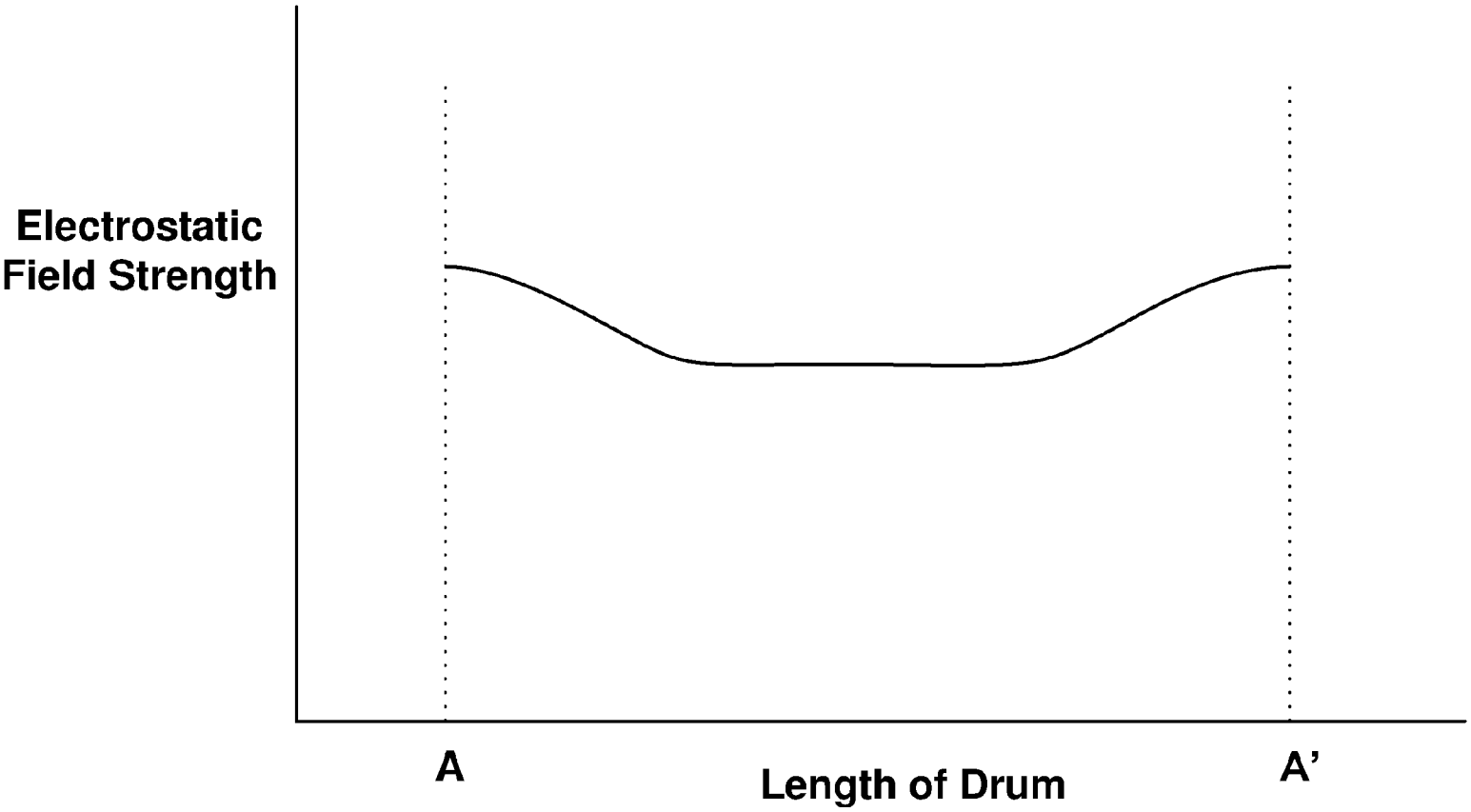
FIG. 2*b* shows a plot of field strength from A to A' as shown in FIG. 2*a*.

The electrostatic field, or the electric component of an electromagnet field, for the electrospinning device 100 of FIG. 1, is shown schematically in FIG. 2*a*. In this Figure, longer arrows represent a greater field strength per unit area. The electrostatic field is generated between the electrospinning device 100 and the grounded target 18 when power is supplied to the electrospinning device 100. The strength of the electrostatic field, at the surface of the rotatable drum 102 facing the target 18, is shown graphically in FIG. 2*b*. In these Figures, the ends of the rotatable drum 102 are respectively labelled A and A'.

As indicated by the length of the arrows, the field strength at each end of the rotatable drum 102 is stronger than in the middle of the rotatable drum 102. In other words, the electrostatic field varies across the length of the rotatable drum 102, and is weakest on the surface of the rotatable drum 102 at the rotatable drum's 102 centre point. That being said, at its weakest point, the electrostatic field at the tips of the protrusions 104 facing the target 18 exceeds 10,000 volts per meter.

In use, the rotatable drum 102 is rotated, and an electrostatic field is generated between the tips of the protrusions 104 of the rotatable drum 102, and the target 18. The field is strongest at the protrusions 104 facing the target 18, and weakens as the protrusions 104 are rotated away. In other words, the electrostatic field is strongest when the distance between the protrusions 104 and the target 18 is at its smallest. The height of the rotatable drum 102 is adjusted such that the protrusions 104 furthest from the target 18 pass through the liquid 14 in the reservoir 12 so that they can pick up the liquid 14.

As the rotatable drum 102 rotates on the axis defined by the spindle 106, liquid 14 is carried on the protrusions 104 in the form of droplets around the rotatable drum 102. The liquid 14 collects on the protrusions 104, and the shape of the protrusions 104 encourages the droplet to form at the tip. As the protrusions 104 approach the target 18, the electrostatic field strength intensifies, and the surface tension of the liquid 14 droplets is overcome. At this point, a stream, or jet, of liquid 14 erupts from the surface of the droplets, as explained in more detail later with reference to FIG. 4. The jet of liquid 14 dries in flight in the form of nano-fibres 22. The nano-fibres 22 contact the target 18, which may also be rotating. The target 18 may rotate at the same velocity as the nano-fibres 22 that approach it, and the nano-fibres 22 wrap around it while being aligned with each other. Within each nano-fibre 22, the nanotubes 24 also align to the axis of the nano-fibre 22.

As a result of the stronger electrostatic field at the ends A, A' of the rotatable drum 22, compared to the centre region, thicker nano-fibres 22 are created at the ends of the rotatable drum 102, and thinner nano-fibres 22 are created at the central region of the rotatable drum 102. Fewer nano-fibres 22 are created by the central region of the rotatable drum 102 in comparison with its end regions. Additionally, for evenly spaced protrusions 104, the alignment of the nano-fibres 22 is more uniform in the central region of the rotatable drum 22, as the electrostatic field at the edges of the rotatable drum 102 varies in direction, as shown in FIG. 2*a*.

FIGS. 3*a-d* show various arrangements of the protrusions 104 on the surface of the rotatable drum 102. In these embodiments, the protrusions 104 are in the form of spinnerets. In other words, the protrusions 104 are spines that receive liquid 14 from an outside source. In the embodiment shown in FIG. 3*a*, the protrusions 104 have a circular base. The protrusions 104 are arranged in a plurality of evenly spaced rows on the surface, and around the rotational axis, of the rotatable drum 102. The rows are uniformly spaced with a distance of about the length of the protrusion 104 between each row. The rows are spaced apart to such a degree that droplets formed on the protrusions 104 do not contact each other. The spinnerets have a high aspect ratio, as described above.

Figure 3A:
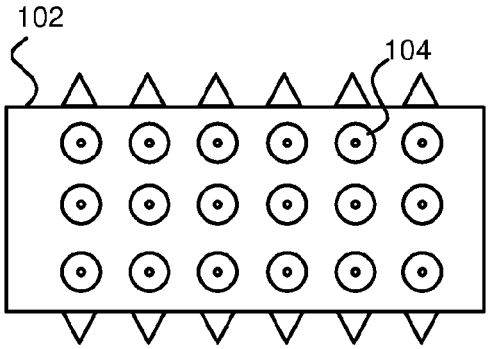
FIG. 3*a* shows a drum according to an embodiment of the present invention.
Figure 3B:
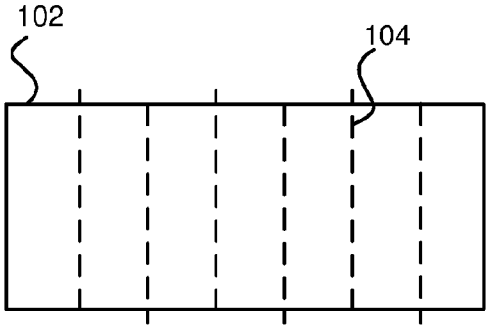
FIG. 3*b* shows a drum according to another embodiment of the present invention.

In the embodiment shown in FIGS. 3*b, c* and *d*, the protrusions 104 are elongated, having a length longer than their width. In FIG. 3*b*, the rows of protrusions 104 are offset from one another, representing a close-packed lattice arrangement. In other words, where there is a space between protrusions 104 in one row, in an adjacent row there is a protrusion 104 opposite the space. In this embodiment, the length of each protrusion 104 is orientated such that it follows the contour of the surface of the rotatable drum 102 around the axis of rotation. In other words, the protrusions 104 are arranged perpendicularly to the axis of the spindle 106. This off-setting allows for tighter packing of protrusions 104 and therefore allows more protrusions 104 to be disposed on the surface of the rotatable drum 102. This results in higher nano-fibre 22 production rates.

Figure 3C:
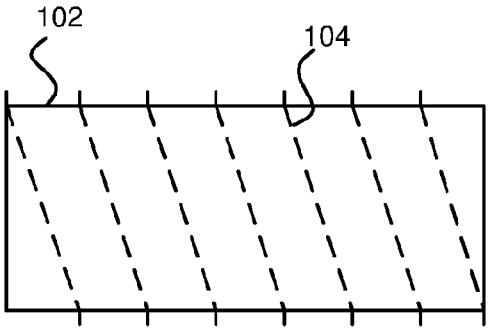
FIG. 3*c* shows a drum according to another embodiment of the present invention.

In the embodiment shown in FIG. 3*c*, the rows of protrusions 104 are not in the same axis of rotation as the rotatable drum 102. Altering the angle of the rows of protrusions 104 allows for nano-fibre 22 production to be covered over the target's entire surface, resulting in a better nano-fibre 22 deposition distribution.

Figure 3D:
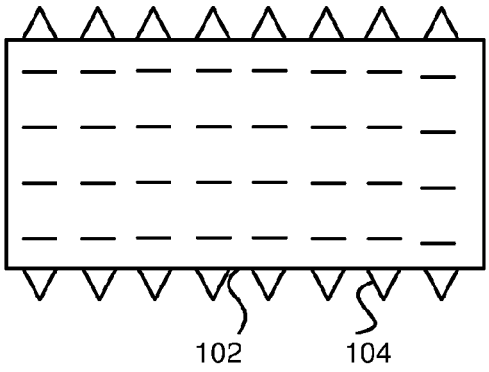
FIG. 3*d* shows a drum according to another embodiment of the present invention.

In the embodiment shown in FIG. 3*d*, the protrusions 104 are formed in evenly spaced uniform rows as in the embodiment shown in FIG. 3*a*. However, in this embodiment, the protrusions 104 are arranged such that the longest sides of each protrusion 104 run in parallel with the axis of the spindle 106.

In all of the embodiments shown in FIGS. 3*a-d*, the protrusions 104 are formed to have an aspect ratio of at least 1:10 (width:height) and are spaced apart by a distance of at least twice the height of the protrusions 104. However, in other embodiments different aspect ratios and/or spacings may be used.

Figure 4:
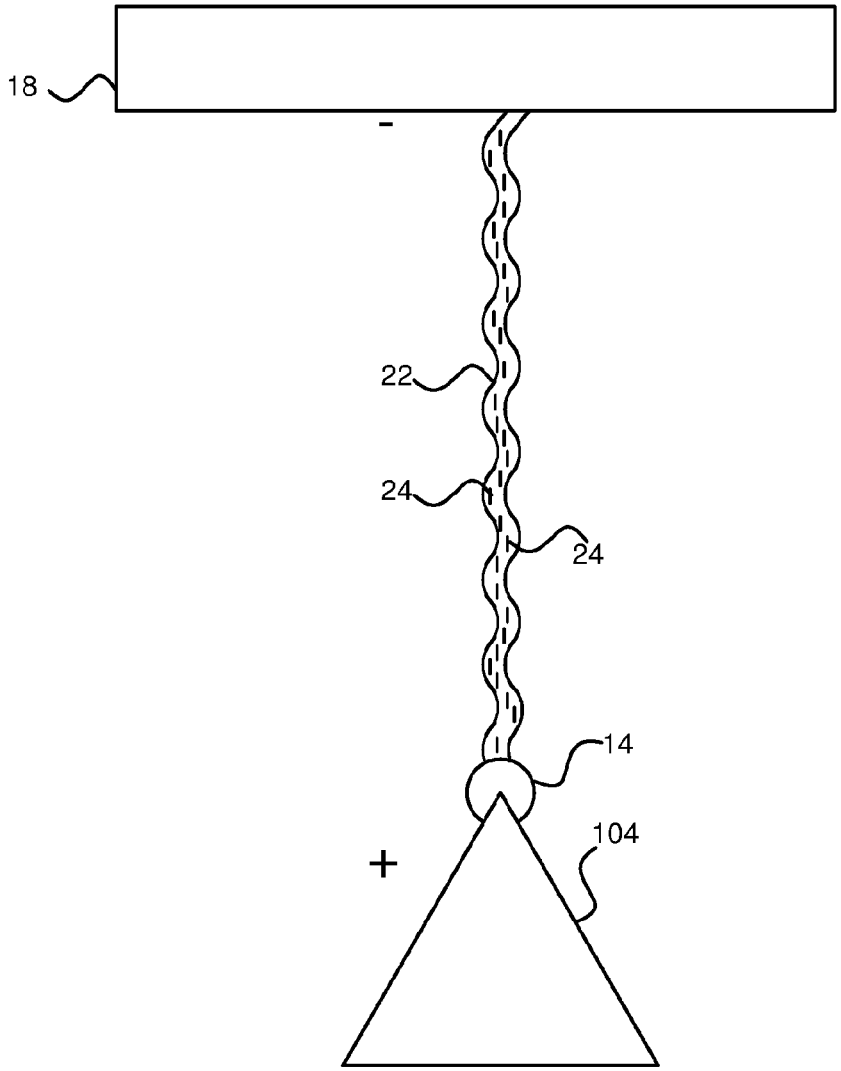
FIG. 4 shows a nanotube fibre according to an embodiment of the present invention.

FIG. 4 shows a Taylor Cone. As previously described, liquid 14 is delivered to the protrusions 104 on the surface of the rotatable drum 102. As the rotatable drum 102 rotates, the liquid 14 gathers on the tips of the protrusions 104 to create droplets. When the electrostatic field strength exceeds the surface tension of the droplets, a Taylor Cone is formed. The shape of a protrusion 104, as previously described, minimises the size of the droplets formed on the protrusion 104. In other words, the electrostatic field strength at the tips of the protrusions 104 quickly exceeds the surface tension of the droplet as the droplet comes into the field of view of the target 18. This results in better alignment of the nano-fibres 22. Additionally, as the protrusions 104 can be spaced closer together, more nano-fibres 22 can be created across the surface of the rotatable drum 102. As the surface tension of the liquid 14 droplets is quickly overcome, longer nano-fibres 22 are possible as the Taylor Cone condition is satisfied sooner.

Upon the Taylor Cone condition being satisfied, a stream of nanotubes 24, contained in the liquid 14, erupts from the surface of the droplet. The nanotubes 24 align within the liquid whilst it is in flight. As the liquid dries, a nanotube-loaded nano-fibre 22 is formed. A nano-fibre typically has a diameter of 100 nm. The nanotube fibre 22 from a particular protrusion 104 breaks away from the protrusion 104 as the rotation of the drum 102 causes the protrusion 104 to re-enter the reservoir 12. In the present embodiment the length of each nano-fibre 22 is approximately 20 metres (m), since the target drum on which the fibres are deposited rotates the equivalent of approximately 20 m in the time taken for one protrusion 104 to be lifted out of the polymer solution 14 by rotation of the rotatable drum 102, begin emitting a fibre, and re-enter the reservoir 12.

To overcome the problem of having an uneven electrostatic field across the length of the rotatable drum 102, in some embodiments, field modifiers 228, 328, 428 are used. The field modifiers 228, 328, 428, are in the form of electromagnetic shields. The field modifiers 228, 328, 428 can be used to control the thickness and alignment of the drawn nano-fibres 22.

In some embodiments, as now described with reference to FIG. 5, the electrospinning device 200 comprises two field modifiers 228*a*, 228*b*. The electrostatic field can be controlled using the field modifiers 228. Here, the field modifiers 228 are configured to balance the electrostatic field across the length of the rotatable drum 102. The field modifiers 228 are electrically connected to the rotatable drum 102. Therefore, when the input voltage is applied to the electrospinning device 200 the field modifiers 228 are at the same potential.

Figure 5:
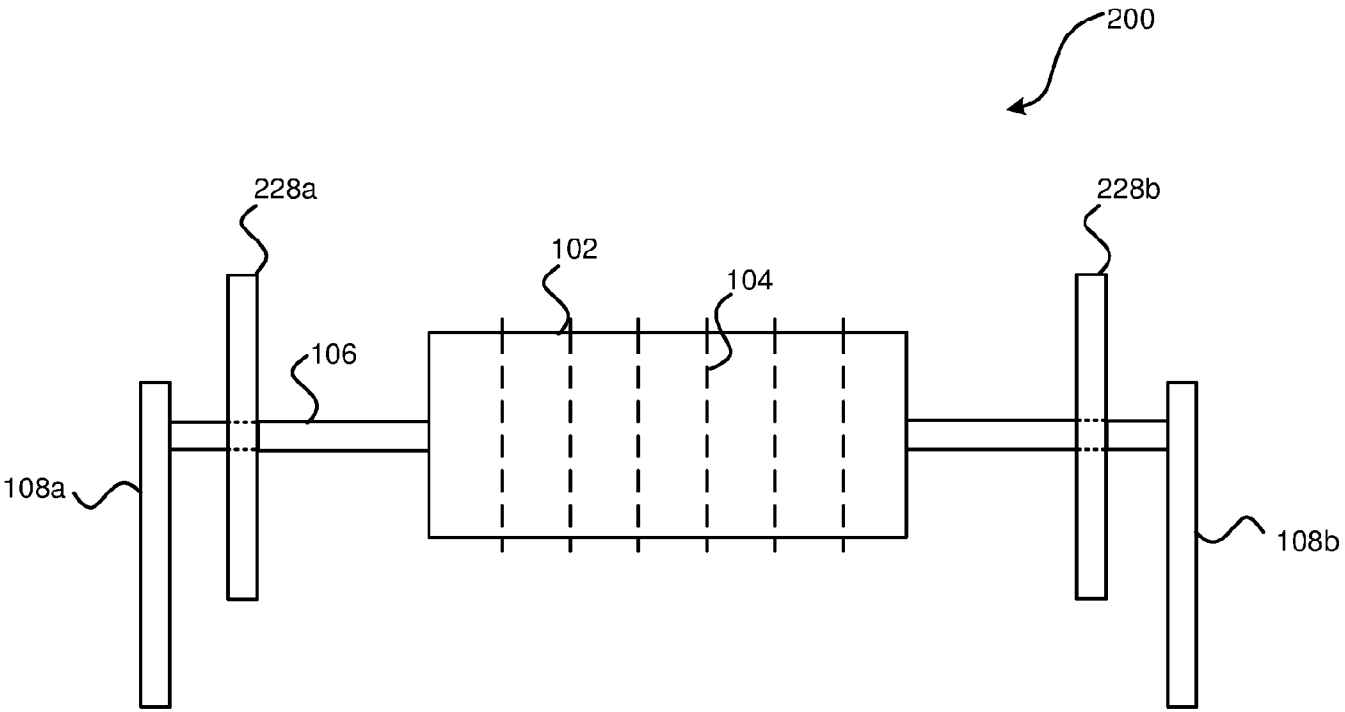
FIG. 5 shows an electrospinning device according to an embodiment of the present invention.

As shown in FIG. 5, the field modifiers 228 are fixed to the spindle 106 on either side of the rotatable drum 102. Each field modifier 228*a*, 228*b* is affixed to the spindle 106 between the respective leg 108*a*, 108*b* and the respective end of the rotatable drum 102. The field modifiers 228, therefore, rotate with the same angular velocity as the rotatable drum 102. In other embodiments, the spindle 106 extends beyond the legs 108, and the field modifiers 228 are affixed to the spindle 106 outside of the legs 108. In some embodiments, the field modifiers 228 have an opening through which the spindle 106 passes, but are not affixed to it. In other words, the spindle 106 rotates relative to the field modifiers 228.

The field modifiers 228 are arranged to balance uniformly the electrostatic field across the width of the protrusions. The field modifiers 228 are metallic in composition. However, it is not essential for the field modifiers 228 to be entirely formed of electrically conducting material. For example, the field modifiers 228 may have a polystyrene or carbon fibre core laminated with a layer of aluminium foil. The field modifiers 228 may comprise further layers, which may be metallic or non-metallic, if necessary for more control over the electrostatic field.

In the embodiment shown in FIG. 5, the field modifiers 228 are circular disks. The disks are 2 cm thick, and have a diameter of 15 cm. Each field modifier 228*a*, 228*b* extends perpendicularly to the axis of the rotatable drum 102 to a height between the tips of the protrusions 104 and the target 18, such that the electrostatic field at each of the tips of the protrusions 104 is greater than a threshold field strength. The threshold in these embodiments is 50 kV/m due to the liquid 14 used, but it will be appreciated that different liquids will require different minimum thresholds. The greater the distance the field modifiers 228 extend above the tips of the protrusions 104, the lower the electrostatic field strength at the tips of the protrusions 104, and the more uniform the strength of the field experienced by each tip. The trade-off between field enhancement and field uniformity is specific for each design and can be modelled using dedicated software packages.

Figure 6A:
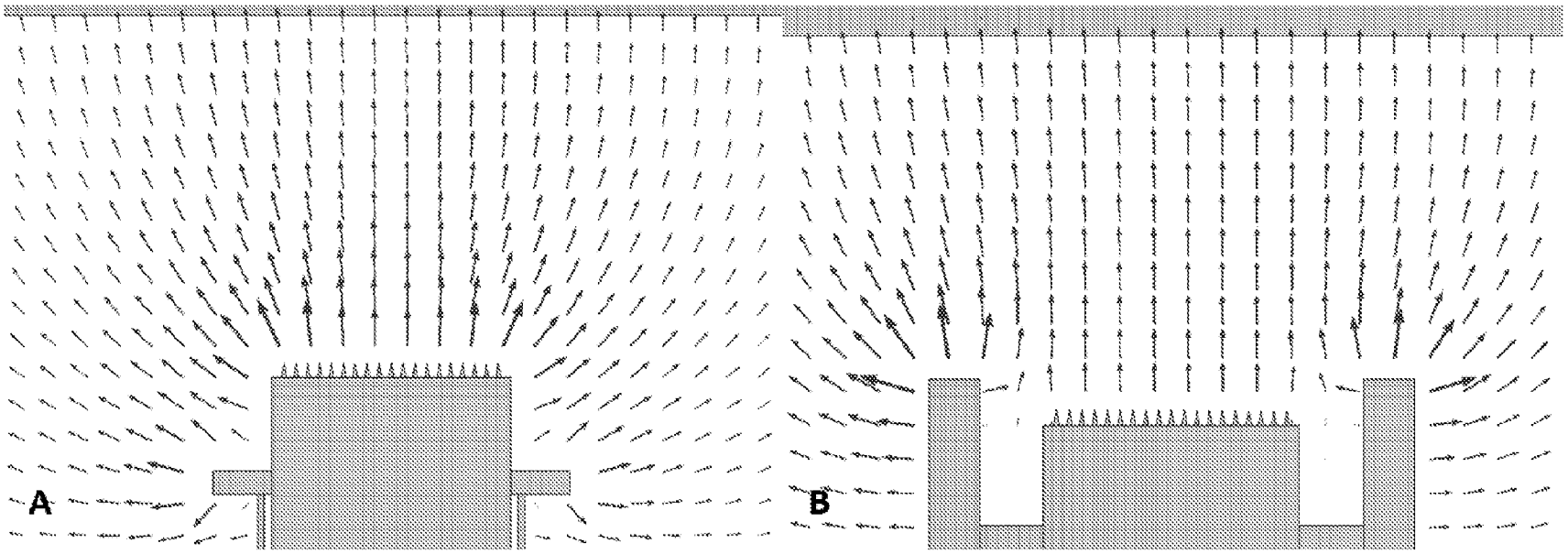
FIG. 6*a* shows a simulation of electrostatic fields generated by the electrospinning devices shown in FIG. 1 and FIG. 5.
Figure 6B:
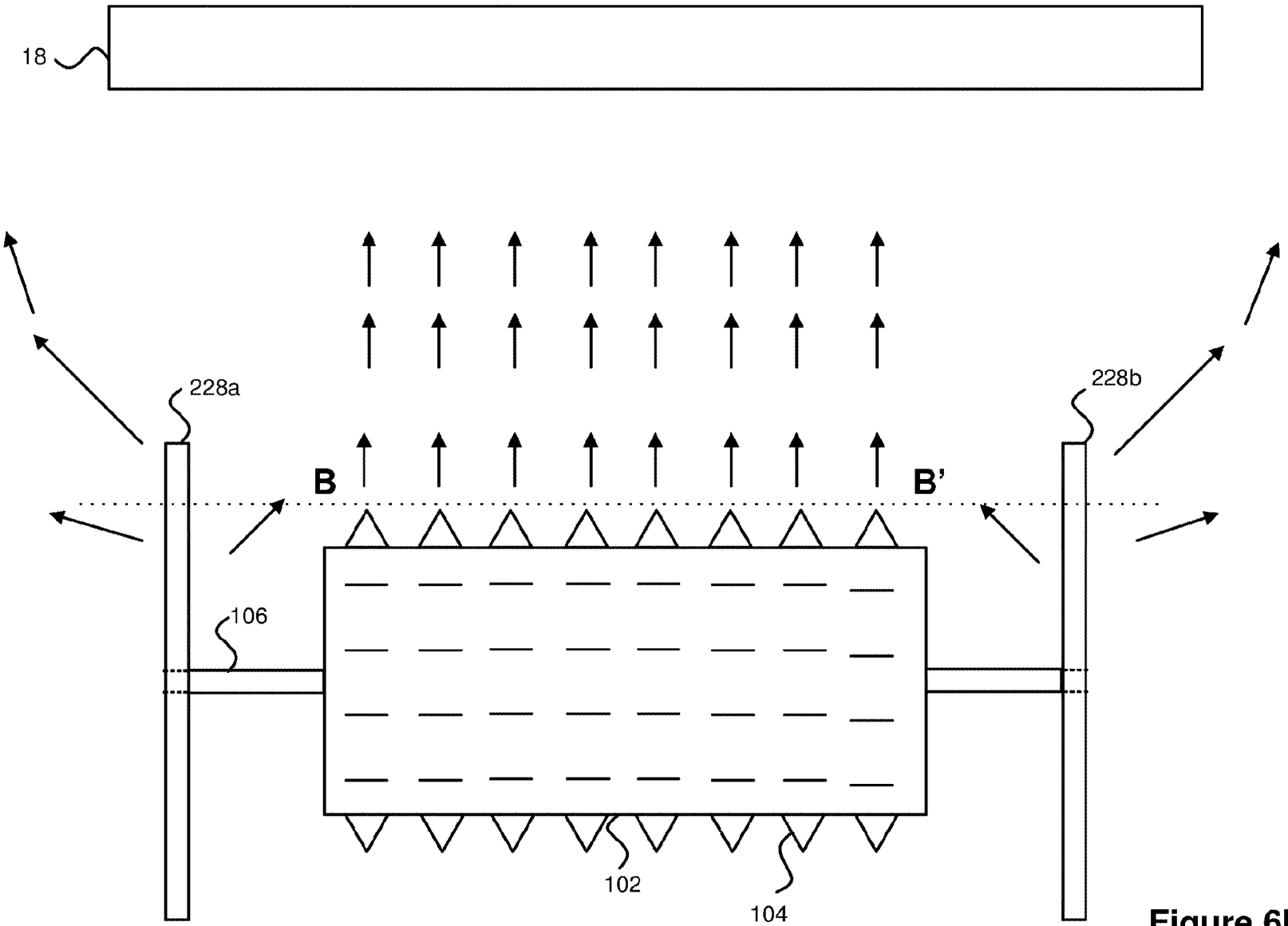
FIG. 6*b* shows a schematic of an electrostatic field diagram associated with the electrospinning device of FIG. 5.
Figure 6C:
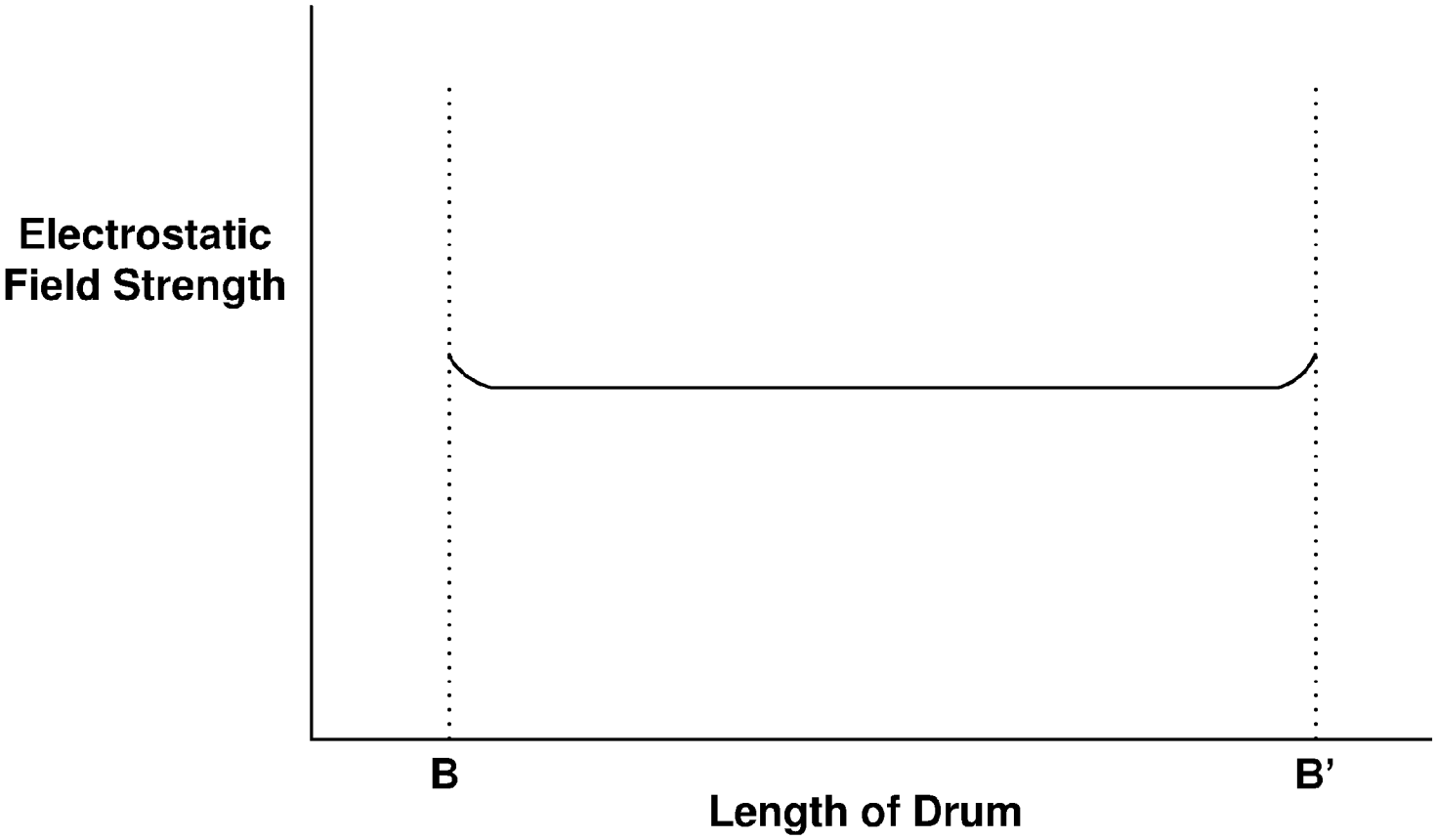
FIG. 6*c* shows a plot of field strength from B to B' as shown in FIG. 6*b*.

The impact of using the field modifiers 228 shown in FIG. 5 on the electrostatic field is shown in the simulation results of FIG. 6*a*. FIG. 6*a* shows a comparison of simulation results for the cases where the field modifiers are and are not present. The simulation results, for the case where the field modifiers 228 are present, are shown in a more idealised representation in FIG. 6*b*. This is also shown graphically in FIG. 6*c*. By disposing the field modifiers 228 outside of the periphery of the rotatable drum 102, the electrostatic field at the ends of the rotatable drum 102 is reduced. In other words, the electrostatic field strength is made uniform across the whole length of the rotatable drum 102 from B to B'. Compared to the previously described embodiments not having field modifiers 228, the nano-fibres 22 exuded by all of the rows of protrusions 104 are of substantially the same thickness as each other. The thickness of nano-fibres 22 at the edges of the rotatable drum 102 is reduced compared to the previous embodiment. Therefore, nanotubes 24 are more aligned with the axis of the nano-fibre 22 across the whole width of the rotatable drum 102, whereas in the case where no field modifiers are present, the nanotubes 24 have a more random orientation at the outer regions of the rotatable drum 102. Having the nanotubes 24 in alignment results in a stronger nano-fibre 22. It also results in a controlled, uniform deposition of the nano-fibres 22 on to the target 18 surface.

Figure 7A:
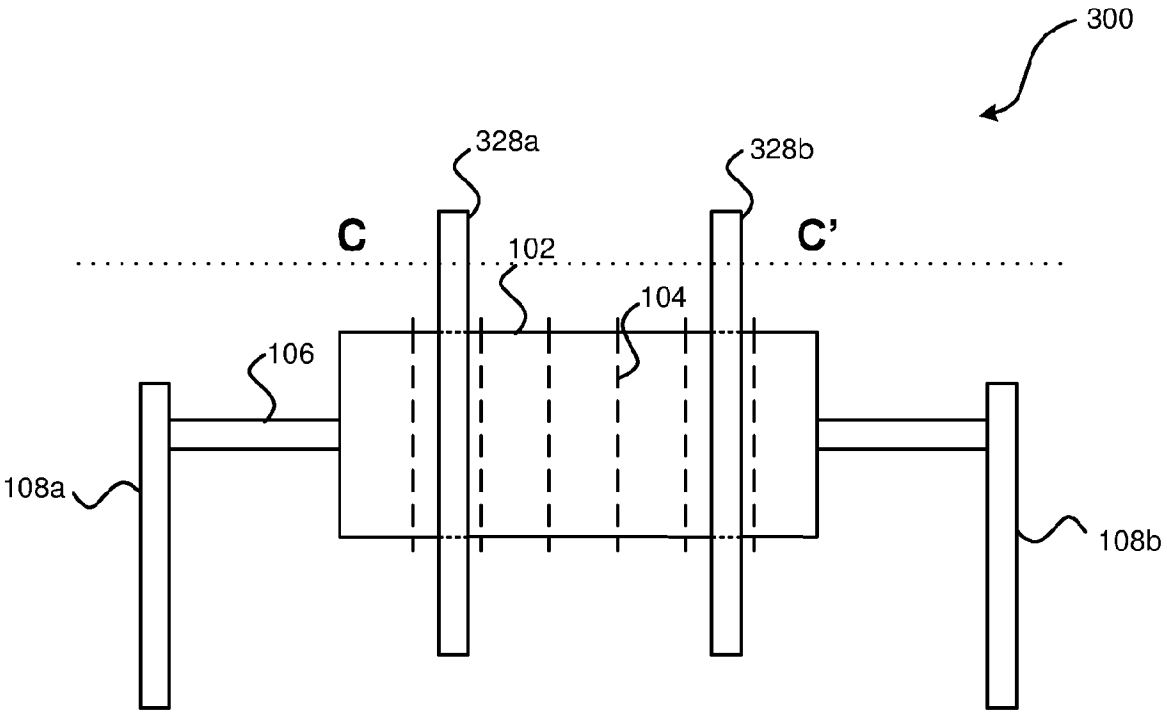
FIG. 7*a* shows an electrospinning device according to an embodiment of the present invention.
Figure 7B:
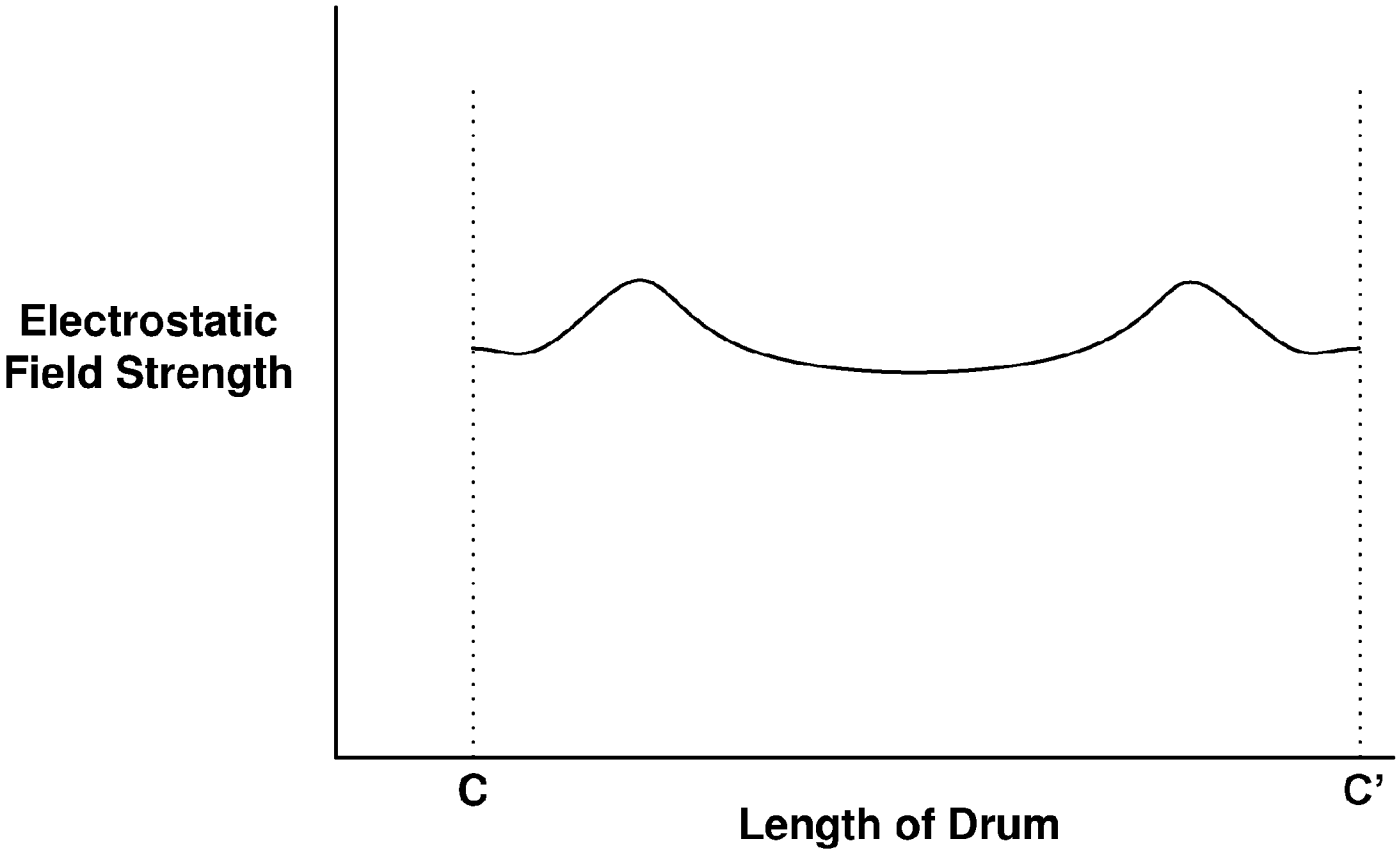
FIG. 7*b* shows a plot of field strength from C to C' as shown in FIG. 7*a*.

FIG. 7*a* shows an electrospinning device 300 according to another embodiment. Here, the field modifiers 328 are disposed on the surface of the rotatable drum 102, between its two ends C, C'. Therefore, rather than smooth the electrostatic field across the length of the rotatable drum 102, the field modifiers 328 control the electrostatic field to be stronger at two discrete points along the length of the rotatable drum 102. The electrostatic field is strongest at a position corresponding to the field modifiers 328. These peaks, situated between the ends C, C' of the rotatable drum 102 are shown more clearly with reference to FIG. 7*b*.

The electrospinning device 300 described with reference to FIG. 7*a* would be used where it is desirable to create nano-fibres 22 of different, yet predictable, thicknesses. For example, the target 18 may be three discrete drums, or a single drum divided into three discrete regions. Here, a single electrospinning device 300 can be used to create three reels of nano-fibres 22, each of a different quality level for different customers or applications.

The field modifiers 328 are detachable from the surface of the rotatable drum 102 so that the electrospinning device 300 can easily be reconfigured to have a different electrostatic field pattern.

Figure 8:
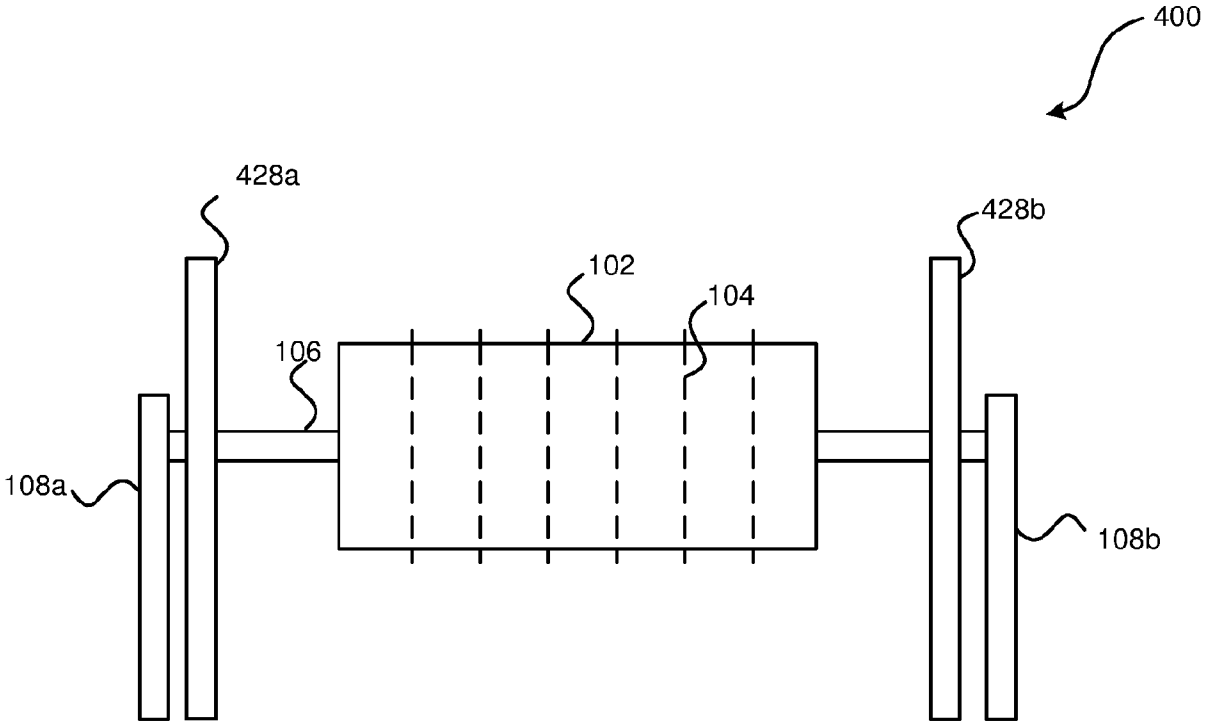
FIG. 8 shows an electrospinning device according to an embodiment of the present invention.

In FIG. 8, the field modifiers 428 do not rotate with the rotatable drum 102. In this embodiment, the field modifiers 428 are fixed and their bases are positioned on the same surface as the bases of the legs 108. Alternatively, the legs 108 may themselves extend higher than the tips of the protrusions 104 facing the target 18. In this case, the legs 108 themselves act as the field modifiers 428. In the arrangements described with reference to FIG. 8, the electrostatic field will remain much the same as that described with reference to FIGS. 6*a*, 6*b* and 6*c*.

Figure 9:
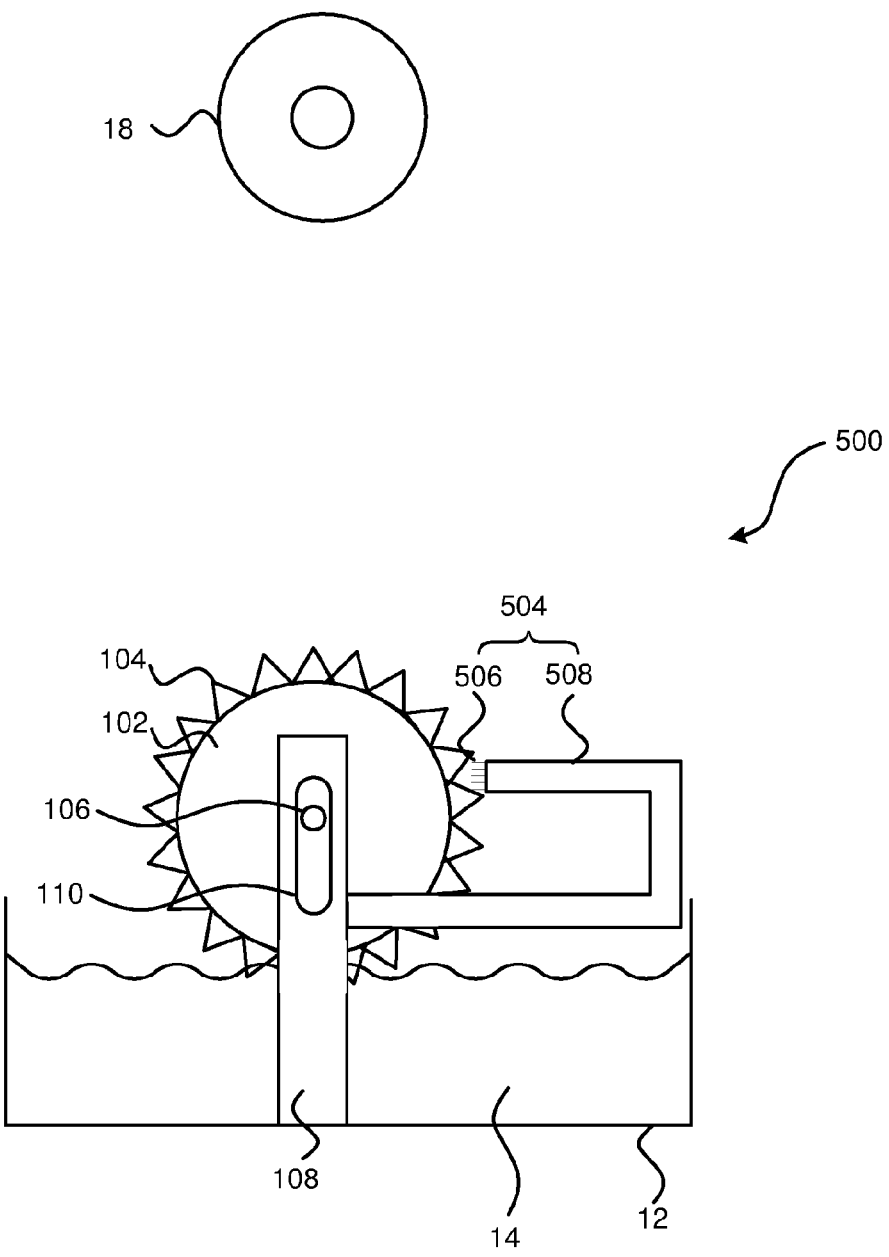
FIG. 9 shows an electrospinning device according to an embodiment of the present invention.

As previously described, the protrusions 104 come into contact with a viscous liquid 14. Having liquid 14 coat the protrusions 104 in a manner which is excessive is disadvantageous. In particular, the liquid 14 may swamp the protrusions 104, hindering the production of Taylor Cones and subsequently nano-fibres 22. A solution to this problem is shown in the embodiment of FIG. 9. Here, the electrospinning device 500 has a brush member 504 disposed at the side of the rotatable drum 102. The brush member 504 is configured to remove excess material from the protrusions 104 before they rotate into a position which begins electrospinning.

The brush member 504 has a support member 508 coupled to each of the legs 108, which hold it in place. The brush member 504 is resistant to the motion of the rotatable drum 102 and the protrusions 104 that traverse through the hairs 506 of the brush member 504. The hairs 506 may be made of wire or any other material suitable for removing excess liquid 14.

Figure 10:
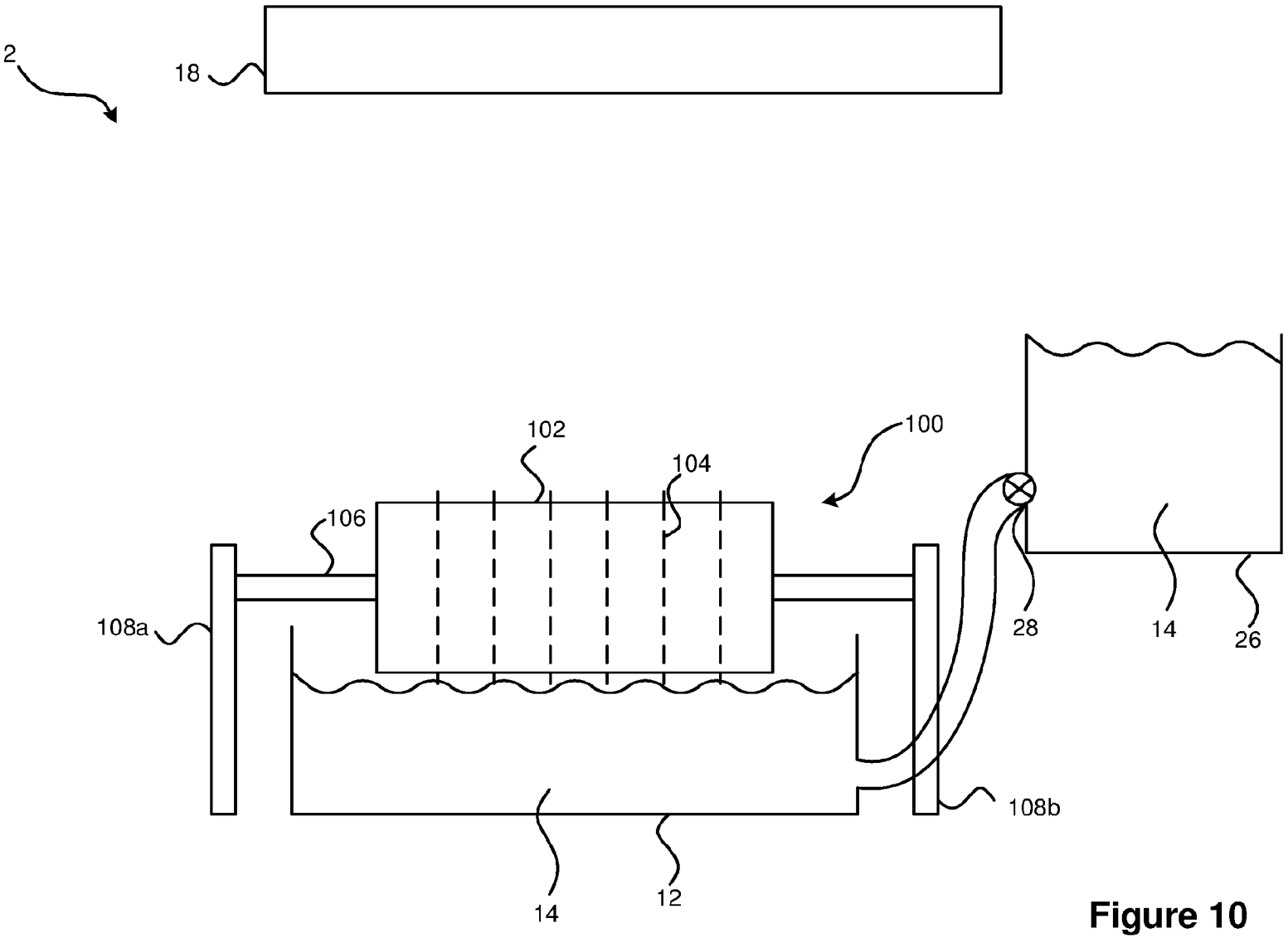

FIG. 10 shows a system 2 according to another embodiment of the invention. Here, the system 2 comprises the same features as the system 1 of FIG. 1, and the description of these features will not be repeated here. Additionally, the system 2 comprises an overflow reservoir 26. The overflow reservoir 26 is in fluid communication with the reservoir 12. The overflow reservoir 26 may comprise control means for controlling the rate of flow of liquid 14 from the overflow reservoir 26 to the main reservoir 12. For example, the control means may comprise a valve (28) that can be configured to open and close to allow liquid 14 to fall under gravity, or peristaltic pressure. The control means may further, or alternatively, comprise a pumping device (not shown).

In use, the overflow reservoir 26 is filled with the same liquid 14 as the reservoir 12. As the rotatable drum 102 rotates and the level of liquid 14 in the reservoir 12 falls, liquid 14 is channelled from the overflow reservoir 26 into the reservoir 12 so that the protrusions 104 on the rotatable drum 102 remain in contact with the surface of the liquid 14. The liquid 14 may be pumped from the overflow reservoir 26 to the reservoir 12 using the pumping device (not shown). In other words, in the system 2, the rotatable drum 102 need not translate toward or away from the bottom of the reservoir 12.

Various modifications will be apparent to the person skilled in the art. For example, the field modifiers 228, 328, 428 may be made of any lightweight material that has the ability to modify an electrostatic field. For example, the field modifiers 228, 328, 428 may be made of titanium, or wood veneered with a layer of aluminium foil.

In the embodiments described above, the field modifiers 228, 328, 428 comprise circular disks. However, the field modifiers 228, 328, 428, may be polygonal and have any number of sides, depending on how the user wishes to control the electrostatic field.

Although embodiments have been described having a plurality of field modifiers 228, 328, 428, it will be apparent to the skilled person that the electrostatic field can be controlled using a single field modifier. For example, a single field modifier can be positioned around the central circumference of the rotatable drum 102 in order to create a peak in field strength at the middle. This will result in thicker nano-fibres 22 being drawn from the central region of the rotatable drum, and thinner nano-fibres 22 being drawn from the end regions of the rotatable drum 102. Additionally, it will be apparent that three or more field modifiers can be used depending on how the user wishes to control the electrostatic field and the required distribution and alignment of nano-fibres 22.

A second reservoir may be disposed alongside the first reservoir 12, the second reservoir being filled with a liquid different to the liquid 14. By having the field modifiers 228, 328, 428 being disposed between the first and second reservoirs of liquid it is possible to electrospin more than one type of nano-fibre at the same time, and to produce heterojunction or multi junction material layers that could be aligned in the substrate plane. The heterogeneity can be controlled across the deposition plane or perpendicular to the deposition plane to produce nano- and micro-scaled surfaces suitable for different application fields.

The legs 108 may be integrated with the sides of the reservoir 12. In other words, the electrospinning device may comprise the reservoir 12. In this embodiment, the axis of the rotatable drum 102 is supported by the sides, or edges, of the reservoir 12. In other words, the spindle 106 passes through the walls of the reservoir 12.

The brush 504 for cleaning the protrusions 104, described with reference to FIG. 9, may be supported by a wall of the reservoir 12 instead of being affixed to the legs 108 of the electrospinning device 500.

In further embodiments, the reservoir 12 may be inside the rotatable drum 102. In these embodiments, a bleed mechanism (not shown) feeds the liquid 14 to the surface of the rotatable drum. The bleed mechanism may comprise a porous skin on the surface of the rotatable drum 102. The liquid 14 then flows onto the protrusions 104 as previously described.

Alternatively in these further embodiments, the protrusions 104 may have a hollow core through which the liquid 14 can egress the rotatable drum 102. The diameter of the hole through which the liquid 14 leaves the protrusion should be small enough so that the previously described field enhancement can be maintained.

The reservoir 12 may also have a means for spraying the liquid 14 onto the rotatable drum 102. In this embodiment, the rotatable drum 102 is not positioned above the reservoir 12, and is not configured to translate up and down.

It will also be appreciated that the target 18 may be implemented as a conveyor belt instead of a rotatable drum. The conveyor belt transports the aligned nano-fibres 22 to where they are processed. For example, the conveyor belt transports the aligned nano-fibres 22 to a weaving device for making a garment.

Although a few exemplary embodiments have been shown and described, it will be appreciated by those skilled in the art that changes may be made in these exemplary embodiments without departing from the principles of the invention, the range of which is defined in the appended claims.

The invention claimed is:

1. An electrospinning device for manufacturing material comprising aligned nano-fibers, the electrospinning device comprising:

a rotor;

a plurality of electrically conducting protrusions disposed on the surface of the rotor and spaced apart from one another, wherein the protrusions are configured such that an electrostatic field created when a potential difference is applied between the rotor and a target is concentrated at the tips of the protrusions and is less concentrated between neighboring ones of the protrusions; and at least two field modifiers electrically connected to the rotor configured to control the strength of the electrostatic field across the length of the rotor such that the strength of the electrostatic field is more uniform across a length of the rotor over which the protrusions are disposed, wherein the at least two field modifiers are disposed on either side of the rotor and are configured to extend to a point between the tips of the protrusions and a target for receiving nano-fibers from the protrusions.

2. The electrospinning device of claim 1, wherein the protrusions are spaced apart such that any two neighboring protrusions are spaced apart by a distance equal to at least twice the height of either one of said two neighboring protrusions.

3. The electrospinning device of claim 1, wherein the protrusions each have an aspect ratio of at least 1:10.

4. The electrospinning device of claim 1, further comprising a brush member, extending the full width of the rotor, arranged to contact the protrusions when the rotor is rotated.

5. The electrospinning device according to claim 1, wherein the at least two field modifiers are arranged at each end of the rotor.

6. The electrospinning device according to claim 5, wherein the at least two field modifiers are arranged coaxially with the axis of the rotor.

7. The electrospinning device according to claim 1, wherein the at least two field modifiers are arranged on the surface of the rotor.

8. The electrospinning device according to claim 1, wherein the at least two field modifiers extend at right angles to the axis of the rotor to a height between the tips of the protrusions and the target.

9. The electrospinning device according to claim 1, wherein the protrusions comprise spinnerets, wherein the surface of each spinneret converges to form a point at the tip of the spinneret.

10. The electrospinning device according to claim 1, wherein the protrusions are conical.

11. The electrospinning device according to claim 1, wherein the protrusions are arranged in evenly spaced uniform rows along the rotational axis of the rotor.

12. A system comprising:

the electrospinning device according to claim 1;

a target for receiving nano-fibers from the protrusions;

a potential difference generator configured to generate a potential difference between the rotor and the target; and a first reservoir arranged to contain a liquid comprising nanotubes, wherein the protrusions receive the liquid from the first reservoir when the rotor is rotated.

13. The system according to claim 12, further comprising a second reservoir in fluid communication with the first reservoir for supplying the reservoir with the first liquid.

14. The system according to claim 12, wherein the walls of the first reservoir extend beyond the surface of the rotor that faces the first reservoir when the rotor is disposed above the first reservoir.

15. The system according to claim 12, wherein the electrospinning device is configured to enable a height of the rotor relative to the reservoir to be adjusted.

16. A method of configuring an electrospinning device for manufacturing material according to claim 1, the method comprising:

determining a configuration of the protrusions such that an electrostatic field created when a potential difference is applied between the rotor and a target is concentrated at the tips of the protrusions and decreases between neighboring ones of the protrusions; and arranging the plurality of protrusions on the surface of the rotor according to the determined configuration.

17. The method of claim 16, wherein the configuration is determined by arranging the spacing between two neighboring protrusions to be equal to at least twice the height of either one of said two neighboring protrusions.

18. The method of claim 16, wherein the protrusions each have an aspect ratio of at least 1:10.

* * * * *